US006149508A

United States Patent [19]

Vanell et al.

[11] Patent Number: 6,149,508

[45] Date of Patent: Nov. 21, 2000

[54] CHEMICAL MECHANICAL PLANARIZATION SYSTEM

[75] Inventors: James F. Vanell, Tempe; Todd W. Buley, Mesa, both of Ariz.

[73] Assignee: Motorola, Inc., Schaumburg, Ill.

[21] Appl. No.: 09/318,951

[22] Filed: May 26, 1999

Related U.S. Application Data

[62] Division of application No. 08/963,487, Nov. 3, 1997.

[51] Int. Cl.[7] ..... B24B 53/00

[52] U.S. Cl. ..... 451/72; 451/56; 451/444

[58] Field of Search ..... 451/41, 60, 446, 451/443, 444, 72, 56

[56] References Cited

U.S. PATENT DOCUMENTS

| | | | |
|---|---|---|---|
| 5,421,768 | 6/1995 | Fujiwara et al. | 451/288 |
| 5,578,529 | 11/1996 | Mullins . | |
| 5,702,563 | 12/1997 | Salugsugan et al. | 451/28 |
| 5,709,593 | 1/1998 | Guthrie et al. . | |
| 5,804,507 | 9/1998 | Perlov et al. . | |
| 5,916,010 | 6/1999 | Varian et al. | 451/287 |
| 5,957,757 | 9/1999 | Berman | 451/56 |
| 6,053,801 | 4/2000 | Pinson et al. | 451/56 |

FOREIGN PATENT DOCUMENTS

| | | | |
|---|---|---|---|
| 0010769 | 1/1991 | Japan | 125/11.01 |

*Primary Examiner*—Robert A. Rose
*Attorney, Agent, or Firm*—A. Kate Huffman

[57] ABSTRACT

A chemical mechanical planarization tool that reduces a volume of polishing chemistry used in a wafer polishing process includes a rinse bar (87) for removing polishing chemistry and particulates from a polishing media and a slurry measurement system (84) for regulating a pump (83) of a slurry delivery system. A volume of the slurry delivery system is reduced to less than 100 milliliters. Approximately a minimum volume of polishing chemistry for polishing a single wafer is dispensed during each wafer polishing process of a wafer lot. During each wafer polishing process the slurry delivery system is purged to prevent settling, agglomeration, and hardening of the polishing chemistry. The rinse bar (87) sprays a surface of the polishing media to remove spent polishing chemistry and particulates prior to polishing another semiconductor wafer.

20 Claims, 5 Drawing Sheets

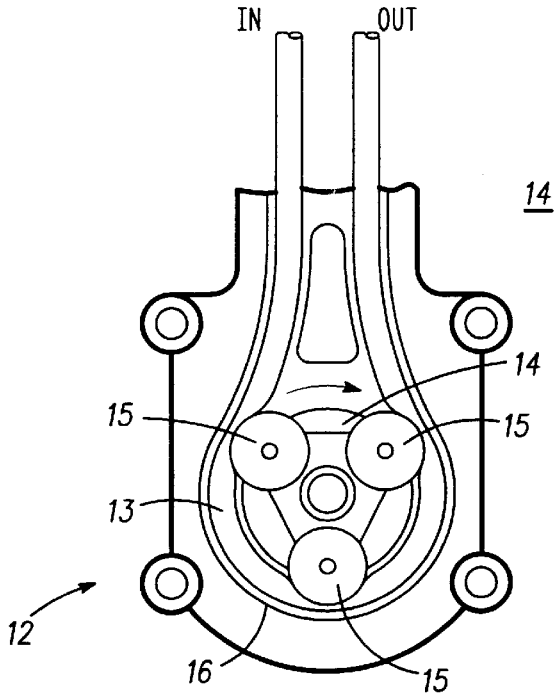
FIG. 1
-PRIOR ART-
FIG. 2
-PRIOR ART-
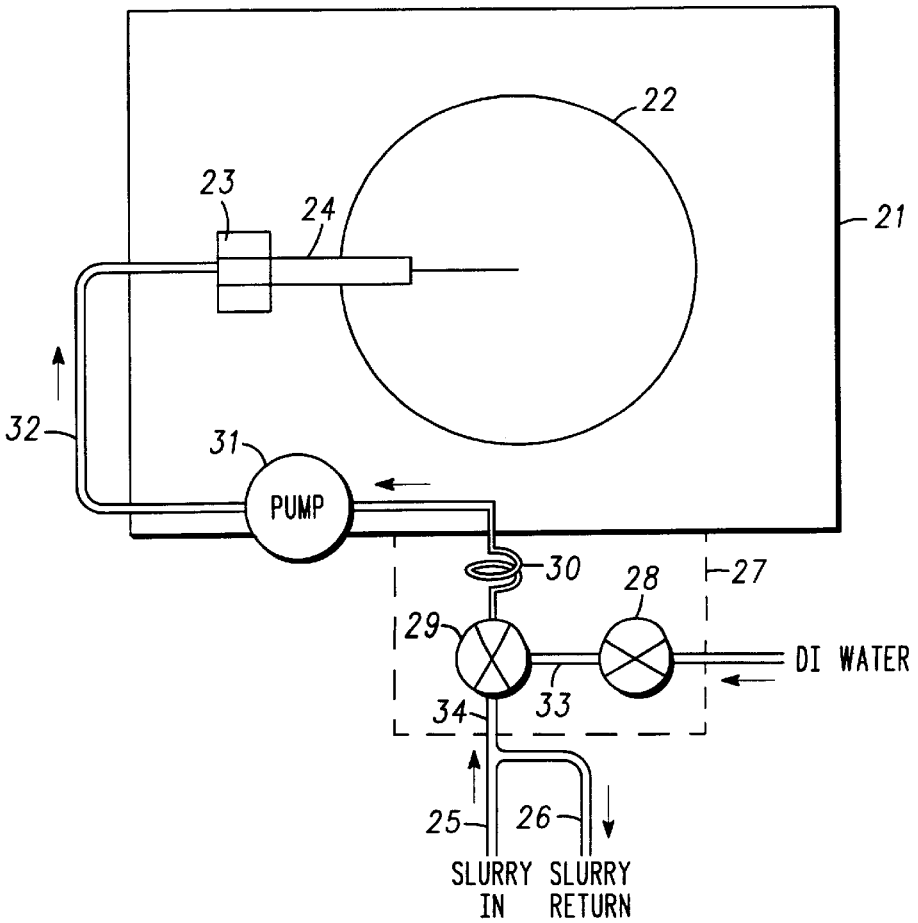

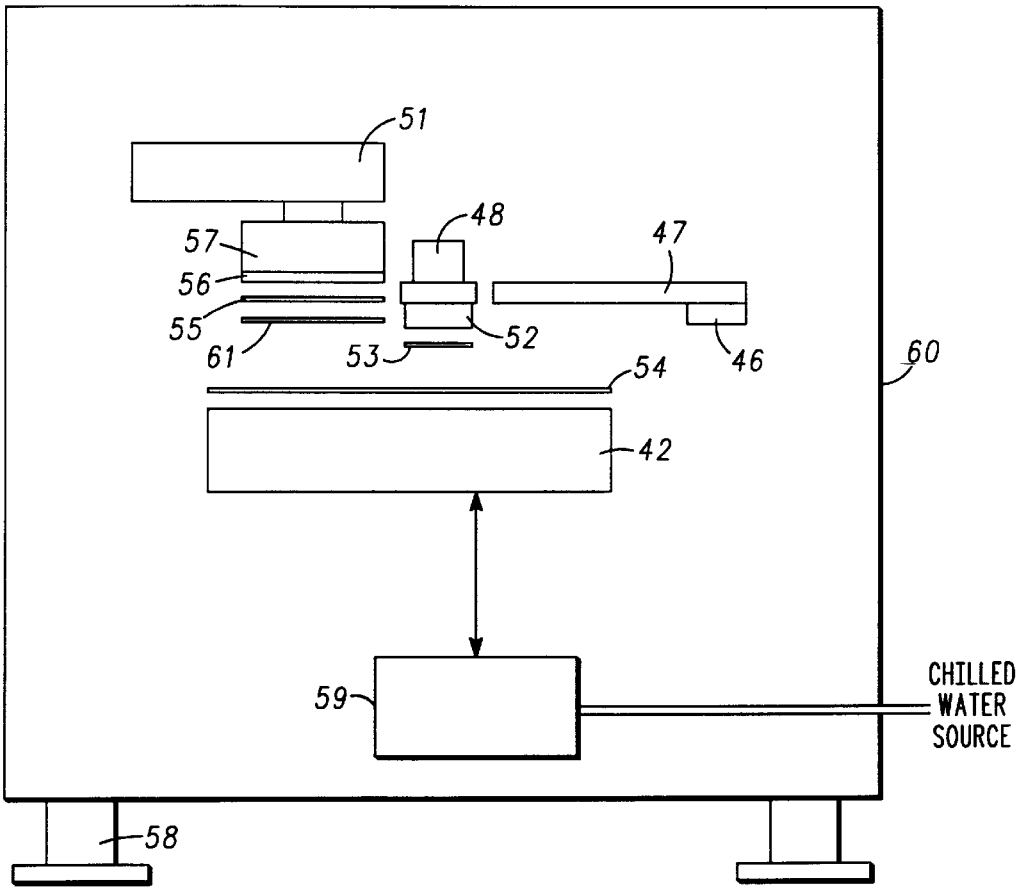
FIG. 4
FIG. 6
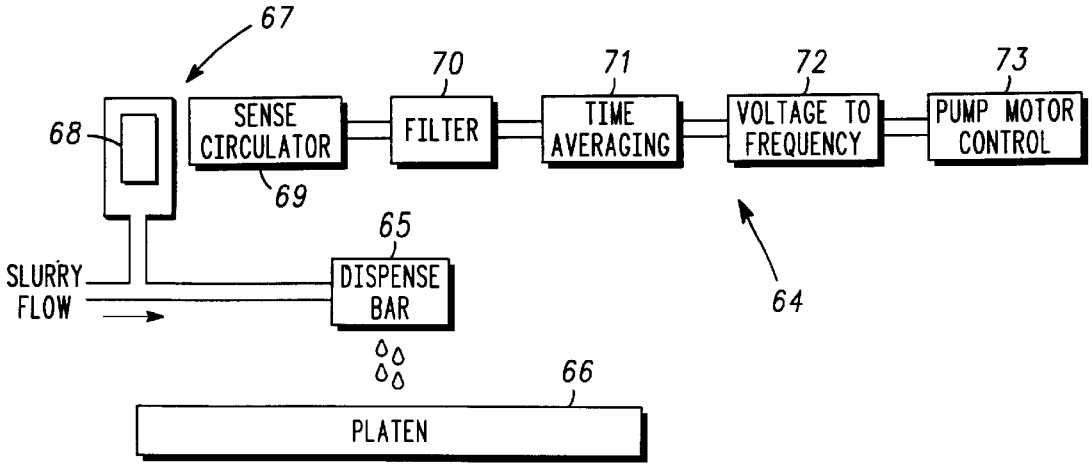

CHEMICAL MECHANICAL PLANARIZATION SYSTEM

This application is a division of Ser. No. 08/963,487 Nov. 3, 1997.

BACKGROUND OF THE INVENTION

The present invention relates, in general, to chemical mechanical planarization (CMP) systems, and more particularly, to polishing chemistry (slurry) delivery systems used in CMP systems.

Chemical mechanical planarization (also referred to as chemical mechanical polishing) is a proven process in the manufacture of advanced integrated circuits. CMP is used in almost all stages of semiconductor device fabrication. Chemical mechanical planarization allows the creation of finer structures via local planarization and for global wafer planarization to produce high density vias and interconnect layers. Materials that undergo CMP in an integrated circuit manufacturing process include single and polycrystalline silicon, oxides, nitrides, polyimides, aluminum, tungsten, and copper.

At this time, the expense of chemical mechanical planarization is justified for components such as microprocessors, ASICs (application specific integrated circuits), and other semi-custom integrated circuits that have a high average selling price. The main area of use is in the formation of high density multi-layer interconnects required in these types of integrated circuits. Commodity devices such as memories use little or no CMP because of cost.

The successful implementation of chemical mechanical planarization processes for high volume integrated circuit designs illustrates that major semiconductor manufacturers are embracing this technology. Semiconductor manufacturers are driving the evolution of CMP in several areas. A first area is cost, as mentioned hereinabove, CMP processes are not used in the manufacture of commodity integrated circuits where any increase in the cost of manufacture could impact profitability. Much of the research in CMP is in the area of lowering the cost per wafer of a CMP process. Significant progress in the cost reduction of CMP would increase its viability for the manufacture of lower profit margin integrated circuits. A second area is a reduction in the size or footprint of CMP equipment. A smaller footprint contributes to a reduced cost of ownership. Current designs for chemical mechanical planarization tools take up a significant amount of floor space in semiconductor process facility.

A third area being emphasized is manufacturing throughput and reliability. CMP tool manufacturers are focused on developing machines that can planarize more wafers in less time. Increased throughput is only significant if the CMP tool reliability also increases. A fourth area of study is the removal mechanism of semiconductor materials. Semiconductor companies are somewhat reliant on a limited number of chemical suppliers for the slurries or polishing chemistries used in different removal processes. Some of the slurries were not developed for the semiconductor industry but came from other areas such as the glass polishing industry. Research will inevitably lead us to high performance slurries that are tailored for specific semiconductor wafer processes. Advances in slurry composition directly impact removal rate, particle counts, selectivity, and particle aggregate size. A final area of research is post CMP processes. For example, post CMP cleaning, integration, and metrology are areas where tool manufacturers are beginning to provide specific tools for a CMP process.

Accordingly, it would be advantageous to have a chemical mechanical planarization tool that has improved reliability in a manufacturing environment. It would be of further advantage for the chemical mechanical planarization tool to reduce the cost of polishing each wafer.

BRIEF DESCRIPTION OF THE DRAWING

FIG. 1 is a cross-sectional illustration of a peristaltic pump used to delivery polishing chemistry in a chemical mechanical planarization tool;

FIG. 2 is an illustration of a prior art slurry delivery system for a chemical mechanical planarization tool;

FIG. 4 is a side view of the chemical mechanical planarization (CMP) tool of FIG. 3 in accordance with the present invention;

FIG. 6 is a schematic diagram of a slurry measurement system for sensing a delivery rate of polishing chemistry in a CMP tool;

DETAILED DESCRIPTION OF THE DRAWING

Figure 3:
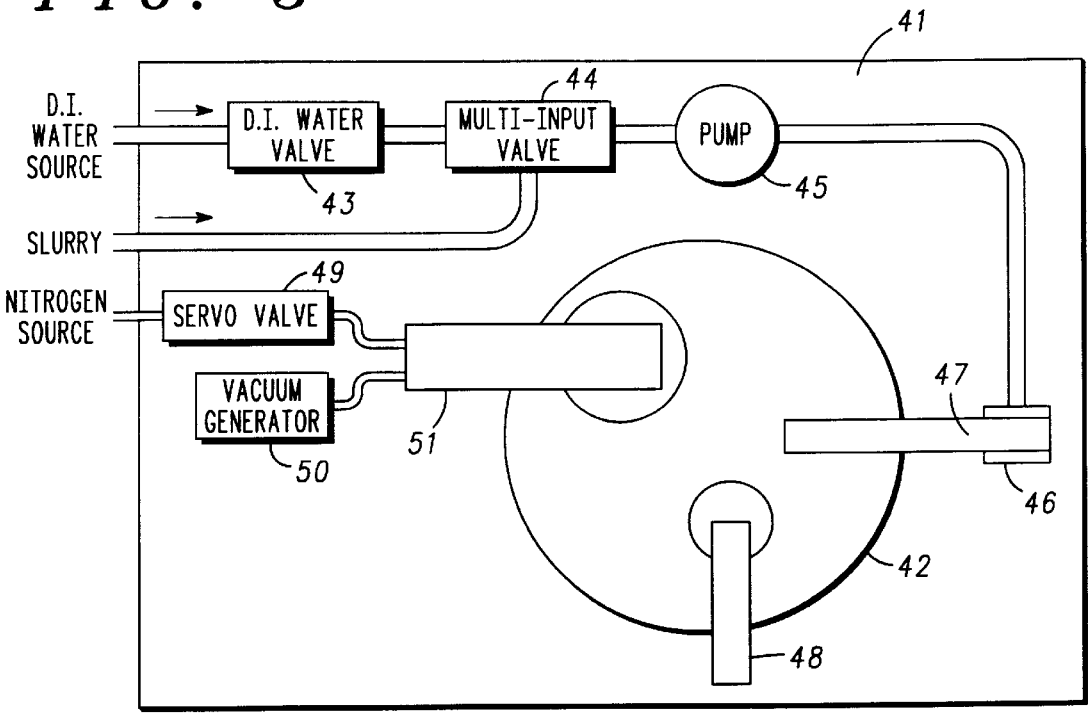
FIG. 3 is a top view of a chemical mechanical planarization (CMP) tool in accordance with the present invention.

A main component used in a chemical mechanical planarization (CMP) process is the polishing slurry. The slurry is a mixture of abrasives and chemicals, which mechanically and chemically remove material from a semiconductor wafer. The chemicals used in a slurry depend on the type of material being removed. Typically, the chemicals are either acidic or basic which makes them strongly corrosive. The slurry is a consumable that is constantly replenished during a process as wafers are polished. This makes it a major consumable cost factor in a CMP process.

Other examples of consumables in a CMP process are deionized water and polishing pads. Polishing pads, which typically comprise polyurethane or some other polishing media, are probably the second highest cost consumable in a CMP process. The cost of a pad per wafer typically is on the order of 25 percent of the cost per wafer of the polishing chemistry. Other consumables cost less than 5 percent of the cost of polishing slurry per wafer. Clearly, the largest gain in reducing the cost of chemical mechanical planarization per wafer can be found in the cost of the polishing slurry.

A slurry delivery system is a component of a chemical mechanical planarization tool. The slurry delivery system provides the polishing chemistry to the semiconductor wafer for polishing. Current CMP tools use peristaltic pumps to deliver the polishing chemistry to the semiconductor wafer. CMP tool manufacturers use peristaltic pumps because they allow the medium being delivered to be isolated from any pump components. This protects the critical pump components from the abrasive and corrosive polishing.

FIG. 1 is a cross-sectional illustration of a peristaltic pump 12 used to deliver a polishing chemistry in a chemical mechanical planarization tool. The isolating mechanism of a peristaltic pump is a flexible tube 13. Ideally, the flexible tubing is impervious to the chemicals in the slurry. For example, flexible tube 13 is commonly made of silicone or norprene-type compounds. The polishing chemistry is delivered through flexible tube 13. The slurry never comes in contact with any component of peristaltic pump 12 by confining the slurry within flexible tube 13. One end of flexible tube 13 is coupled to an input (IN) for receiving slurry while the other end of flexible tube 13 is coupled to an output (OUT) of peristaltic pump 12.

A rotor 14 spins within a housing 16 of peristaltic pump 12. Rotor 14 is coupled to a motor (not shown). Attached to rotor 14 are rollers 15 for progressively compressing flexible tube 13. A minimum of two rollers are used in a peristaltic pump while some pump designs have many more rollers. The slurry is pushed or squeezed through flexible tube 13 as the rollers rotate within housing 16. An advantage of a peristaltic pump is freedom from internal leakage. Leakage only occurs if the tube ruptures. The amount of material that is delivered by peristaltic pump 12 is determined by the tube internal diameter, durometer, wall thickness, and delivery pressure. The rate of output delivery or the flow rate generated by pump 12 can be increased or decreased by varying pump speed.

As mentioned previously, the highest consumable cost in a chemical mechanical planarization process is the polishing chemistry. Currently, a delivery rate of polishing chemistry is determined by the CMP tool and the polishing characteristics required for a semiconductor wafer process. Chemical mechanical planarization tools are built to serially polish wafers of a wafer lot although some can polish more than one wafer at a time. A wafer lot is more than one semiconductor wafer and typically comprises more than 20 wafers. The wafer that has the most impact on the delivery rate of polishing chemistry is the last wafer processed in the wafer lot.

Serially processing wafers of a wafer lot allows the accumulation of spent polishing chemistry and particulates from previously polished wafers. Centrifugal force of a moving platen removes some of the polishing chemistry and particulates but it is not effective nor can it be counted on as a true cleaning procedure. Mapping the quality of a semiconductor wafer polishing process clearly produces a downward trend as the number of wafers polished increases. The delivery rate of polishing chemistry is selected to ensure that the last wafer of a wafer lot meets the specifications of the wafer process.

In general, CMP tools are set to provide substantially more than a minimum amount of polishing chemistry needed to polish a single semiconductor wafer. The initial selected flow rate of polishing chemistry compensates for degradation in pump delivery rate over time, build up of particulates during polishing of a wafer lot, and the mixing of old and new polishing chemistry. Providing more than the minimum amount of polishing chemistry needed to polish a single semiconductor wafer increases manufacturing costs but prevents non-uniform polishing, or worse, wafer damage. Semiconductor manufacturers provide more slurry than required because the long term cost of polishing chemistry is less than the cost of damaged semiconductor wafers.

A first issue that affects the polishing chemistry delivery rate is the input pressure to peristaltic pump 12. The input pressure of the polishing chemistry can vary significantly, for example, a range of 1406.2–7031.0 per square meter (2–10 pounds per square inch) of slurry pressure would not be uncommon. The input pressure range extends high enough where flexible tube 13 may be damaged under the right circumstances causing the CMP tool to be shutdown for pump repair. The input pressure also directly impacts the flow rate of peristaltic pump 12. In fact, the delivery rate goes up with higher input pressures because flexible tube 13 expands thereby carrying a larger volume of polishing chemistry. Peristaltic pump 12 is set up to provide a predetermined flow rate at a low input pressure (flexible tube 13 is not expanded). Thus, the predetermined flow rate is exceeded anytime the input pressure of the slurry expands flexible tube 13 wasting polishing chemistry and increasing manufacturing costs.

A second issue affecting the delivery rate of peristaltic pump 12 is plastic deformation. Plastic deformation is the inability of flexible tube 13 to rebound to its original shape and size. Rollers 15 of peristaltic pump 12 continuously squeeze or milk flexible tube 13 to deliver the polishing chemistry. Initially, flexible tube 13 rebounds to its original shape after being flattened by rollers 15. Progressively, plastic deformation occurs and flexible tube 13 does not rebound as much thereby changing the volume being delivered. In other words, flexible tube 13 takes a set or deforms over time. The degradation of peristaltic pump 12 is compensated by running it at a higher speed. The higher speed is determined by the service interval of peristaltic pump 12. The service interval is an acceptable time period that prevents flexible tube 13 from splitting, thereby preventing a catastrophic failure that shuts down the CMP tool. A typical service interval for the replacement of flexible tube 13 in peristaltic pump 12 is approximately a month. The speed selected compensates for a worst case degradation of a peristaltic pump. Using the worst case value ensures the flow rate of peristaltic pump 12 will exceed the predetermined flow rate at the service interval. A second order effect is that increasing the slurry delivery rate by running the speed of peristaltic pump 12 at higher revolutions per minute accelerates the rate of plastic deformation of flexible tube 13 over time. The volume of polishing chemistry delivered when peristaltic pump 12 exceeds the predetermined flow rate due to pump degradation or high input pressure is wasted.

Currently, chemical mechanical planarization tool manufacturers do not offer any type of real time sensing of the polishing chemistry flow rate which prevents incorporating a system that compensates for changes in the input pressure of the polishing chemistry or the reduced efficiency of the peristaltic pump over time. The standard compensation technique used by semiconductor manufacturers today for CMP tool pump degradation is to set the pump at a high delivery rate. A high production semiconductor processing facility cannot chance that the polishing chemistry flow rate falls to a point where semiconductor wafers are damaged. It is estimated that the increased flow rate of a typical chemical mechanical planarization system wastes approximately 25 percent or more of the slurry. It is not uncommon for a facility to be operating at a deliver rate exceeding 50 percent more than is needed to polish a semiconductor wafer.

FIG. 2 is an illustration of a prior art slurry delivery system for a chemical mechanical planarization tool. The slurry delivery system provides a polishing chemistry to a surface of a polishing media on platen 22. The polishing media is typically a polyurethane pad that is adhesively attached to platen 22. The polishing media provides a surface suitable for the transport of the polishing chemistry to a semiconductor wafer for planarization. The polishing media is also compliant to allow for global and local wafer surface irregularities. Pump 31 as described hereinabove is set at a slurry delivery rate that greatly exceeds a minimum required delivery rate to account for pump degradation over time.

Slurry is provided from a global slurry delivery system via line 25. A return line 26 allows the polishing chemistry to be constantly recirculated. A drawer 27 holds a two way valve 28, a three way valve 29, and a line 30. Drawer 27 allows two way valve 28 and three way valve 29 to be serviced. Typically, drawer 27 houses several valve systems and other components for a chemical mechanical planarization tool. Drawer 27 slides into the chemical mechanical planarization tool to minimize the footprint of the tool.

Two way valve 28 allows a liquid such as deionized (DI) water to be provided to three way valve 29. The DI water is used to purge and cleanse the slurry delivery system of polishing chemistry or other chemicals. The DI water is typically provided from a factory source. Two way valve 28 has an input and an output. Two way valve 28 is activated/deactivated by an electric or pneumatic signal.

Three way valve 29 allows the polishing chemistry or deionized water to be selected to flow through the slurry delivery system. Three way valve 29 has a first input, a second input, and an output. A line 34 couples line 25 to the first input of three way valve 29. Line 34 is a line downstream of line 26 (slurry return line) A line 33 couples the output of two way valve 28 to the second input of three way valve 29.

An enclosure 21 is a sealed environment for the planarization of wafers. Enclosure 21 contains the chemical vapors and particulates to prevent human exposure and for environmental processing of hazardous materials. In an embodiment of the slurry delivery system, an input and output of pump 31 are inside enclosure 21. A line 30 couples the output of three way valve 29 to the input of pump 31. Note that line 30 has a coiled-section which allows line 30 to extend when drawer 27 is opened.

A platen 22, a dispense bar manifold 23, and a dispense bar 24 are housed within enclosure 21. Platen 22 supports a semiconductor wafer during a planarization process. A line 32 couples the output of pump 31 to an input of dispense bar manifold 23. As shown, line 32 exits enclosure 21 and re-enters near dispense manifold 23. Dispense bar manifold 23 routes DI water, chemicals, or polishing chemistry to dispense bar 24. Dispense bar 24 is suspended over platen 22 to dispense the DI water, chemicals, or polishing chemistry to a polishing media on platen 22.

In general, the polishing chemistry used to remove material from a semiconductor wafer cannot be allowed to sit or dry in the delivery system without dire consequences such as hardening, agglomeration, and settling. Some types of polishing chemistry literally harden to a concrete or rock like substance if allowed to dry. Agglomeration is the formation of large particles from the association of smaller particles in the solution. For example, one type of polishing chemistry is a colloidal suspension. The acidity or basicity of the solution is critical to the suspension. The particles in the solution will attract to one another forming larger particles should the pH fall above/below some nominal value. Settling is the process of the polishing chemistry falling out of suspension and the demixing of chemicals. The polishing chemistry, if allowed to harden, agglomerate, or settle subsequently clogs the delivery system, which results in a system that does not perform correctly, or damages a wafer.

A first method used to prevent settling, agglomeration, and hardening is to recirculate the polishing chemistry. Recirculation keeps the slurry in constant motion. For example, polishing chemistry from a global slurry delivery system that services several CMP tools includes a recirculation path (line 26) back to a main supply tank.

A second method commonly employed in CMP tools is to purge a slurry delivery system when it is idle for an extended period of time. Purging the slurry delivery system eliminates any possibility of settling, agglomeration, or hardening. The slurry delivery system is typically purged with a liquid such as deionized water. A typical slurry delivery system has an internal volume of 500 milliliters or more. Pump 31 of the chemical mechanical planarization tool is operated at high speeds to purge the system quickly. Operation of pump 31 at high flow rates is limited by dispense bar 24. Exceeding the high flow rate (for example, 500 milliliters/minute) causes slurry to be sprayed all over the tool which will harden and require maintenance. Wafer damage will result should the hardened polishing chemistry fall back on the polishing media.

Operating pump 31 at the high speed flow rate of 500 milliliters/minute will displace the slurry delivery system with DI water in approximately one minute. The deionized water in the slurry delivery system must also then be displaced in order to begin polishing wafers. Thus, more than two minutes are required for a purging operation. Semiconductor manufacturers purge the slurry delivery system of a CMP tool when wafer lots are being changed in/out. The relatively long delay as wafer lots are changed in/out have produced settling, agglomeration, and hardening. The time required to remove a polished wafer lot and provide a new wafer lot for polishing is greater than the purging operation. Thus, wafer lot change out is an ideal time to purge the system without introducing delay in the CMP manufacturing process. Still, settling, agglomeration, and hardening is not limited to wafer lot change outs. Anytime the slurry delivery system is idle there is the potential for wafer damage or system failure.

Review of the chemical mechanical planarization tools being offered for sale indicate that the lines (lines 30,32) used for the delivery of polishing chemistry have an inner diameter of approximately 0.95 centimeters and are between 2 to 5 meters long. In general, the volume of the slurry delivery system comprises three way valve 29, line 30, pump 31, line 32, line 33, dispense bar manifold 23, and dispense bar 24. A typical volume of a slurry delivery system is greater than 500 milliliters. The volume of the slurry delivery system exceeds the amount of slurry used in the polishing of a single semiconductor wafer. Thus, purging the system wastes a significant amount of polishing chemistry. The length of time required to purge the system limits its use to wafer lot change outs. Prior to polishing a first wafer of a wafer lot, the DI water (500 milliliters) in the slurry deliver system is displaced by polishing chemistry. The amount of DI water placed on the polishing media prior to polishing the first wafer is significant. Water puddling on the polishing media surface dilutes the polishing chemistry as it is dispensed. Dilution of the slurry changes the rate at which material is removed from the first several semiconductor wafers processed and ultimately could affect wafer flatness.

In a semiconductor manufacturing environment, the wafer throughput per hour is an important measure of a process. The speed of a process directly relates to the cost of the finished integrated circuit. Cost often dominates a decision to use a process even though the process may improve performance or quality. The time needed to purge the slurry delivery system in a CMP tool is approximately one minute. Thus, the minimum time needed to provide DI water and then polishing chemistry to the polishing media is about two minutes. The time required for a typical planarization process is approximately three minutes. A factory running 100,000 wafers a week would have CMP tools idle for approximately 133 hours a week (assuming 25 wafer lots) if this process was added once in the process of a wafer lot. The cost/benefit of adding a DI water purge translates to a reduction of 2667 wafers processed per week.

A DI water flush between wafer lots can produce damage to a peristaltic pump. As mentioned previously, a peristaltic pump is sensitive to input pressure. The flexible tube in a peristaltic can rupture if the input pressure of the water provided to the pump. Rollers in the pump pinch the flexible tube against the housing. Water pressure at the input of the peristaltic pump causes the flexible tube to inflate and rupture.

A problem with the slurry delivery system is the large volume of lines 30, 32, and 33, pump 31, dispense bar manifold 23, and dispense bar 24. These areas are dead legs in the slurry delivery system. Dead legs are areas where the polishing chemistry sits when the flow is stopped. A large volume of polishing chemistry is idle during a time period when a polished semiconductor wafer is removed and a new wafer is brought in place to be polished. Also, all recipes for wafer polishing call for a stoppage of slurry flow. Having a large volume of idle slurry increases the probability that hardening, agglomeration, or settling occurs. The amount of settling and agglomeration is a function of the length of time and volume of non-moving polishing chemistry. It is not uncommon for agglomeration and settling to clog the slurry delivery system, produce non-uniform planarization, out of specification wafers, or scratched wafers. Agglomerates and settled materials can clog the slurry delivery system causing it to be taken out of service until the blockage is removed.

A situation worse than agglomeration or settling in a CMP production environment is hardening of the polishing chemistry. Hardening occurs because the polishing chemistry is not moving and small pockets of the material are formed in the lines or components which are exposed to trapped gas that can aid in the drying and hardening of the slurry. For example, the coiled lines in line 30 are notorious for forming pockets of polishing chemistry that can harden when the polishing chemistry is non-moving. Similarly, line 32 is routed in many different directions to couple to dispense bar manifold that forms areas where slurry can harden. The CMP tool has to be shut down once any portion of the polishing chemistry hardens in a dead leg. Polishing chemistry can no longer be pumped, and the lines or components must be replaced. The pump can also be damaged trying to pump through a blocked passage.

FIG. 3 is a top view of a chemical mechanical planarization (CMP) tool 41 in accordance with the present invention. CMP tool 41 comprises a platen 42, a deionized (DI) water valve 43, a multi-input valve 44, a pump 45, a dispense bar manifold 46, a dispense bar 47, a conditioning arm 48, a servo valve 49, a vacuum generator 50, and a wafer carrier arm 51.

Platen 42 supports various polishing media and chemicals used to planarize, for example, a processed side of a semiconductor wafer. Platen 42 is typically made of metal such as aluminum or stainless steel. A motor (not shown) couples to platen 42. Platen 42 is capable of rotary, orbital, or linear motion at user-selectable surface speeds.

Deionized water valve 43 has an input and an output. The input is coupled to a DI water source. Control circuitry (not shown) enables or disables DI water valve 43. DI water is provided to multi-input valve 44 when DI water valve 43 is enabled. Multi-input valve 44 allows different materials to be pumped to dispense bar 47. An example of the types of materials which are input to multi-input valve 44 are chemicals, slurry, and deionized water. In an embodiment of CMP tool 41, multi-input valve 44 has a first input coupled to the output of DI water valve 43, a second input coupled to a slurry source, and an output. Control circuitry (not shown) disables all the inputs of multi-input valve 44 or enables any combination of valves to produce a flow of selected material to the output of multi-input valve 44.

Pump 45 pumps material received from multi-input valve 44 to dispense bar manifold 46. The rate of pumping provided by pump 45 is user-selectable. Minimizing flow rate variation over time and differing conditions permits the flow to be adjusted near the minimum required flow rate, which reduces waste of chemicals, slurry, or DI water. Pump 45 has an input coupled to the output of multi-valve 44 and an output.

Dispense bar manifold 46 allows chemicals, slurry, or DI water to be routed to dispense bar 47. Dispense bar manifold 46 has an input coupled to the output of pump 45 and an output. An alternate approach utilizes a pump for each material being provided to dispense bar 47. For example, chemicals, slurry, and DI water each have a pump that couples to dispense bar manifold 46. The use of multiple pumps allows the different materials to be precisely dispensed in different combinations by controlling the flow rate of each material by its corresponding pump. Dispense bar 47 distributes chemicals, slurry, or DI water onto a polishing media surface. Dispense bar 47 has at least one orifice for dispensing material onto the polishing media surface. Dispense bar 47 is suspended above and extends over platen 42 to ensure material is distributed over the majority of the surface of the polishing media.

Wafer carrier arm 51 suspends a semiconductor wafer over the polishing media surface. Wafer carrier arm 51 applies a user-selectable downforce onto the polishing media surface. In general, wafer carrier arm 51 is capable of rotary motion as well as a linear motion. A semiconductor wafer is held onto a wafer carrier by vacuum. Wafer carrier arm 51 has a first input and a second input.

Vacuum generator 50 is a vacuum source for wafer carrier arm 51. Vacuum generator 50 generates and controls vacuum used for wafer pickup by the wafer carrier. Vacuum generator 50 is not required if a vacuum source is available at the manufacturing facility. Vacuum generator 50 has a port coupled to the first input of wafer carrier arm 51. Servo valve 49 provides a gas to wafer carrier arm 51 for wafer ejection after the planarization is complete. The gas is also used to put pressure on the backside of a wafer during planarization to control the wafer profile. In an embodiment of CMP tool 41, the gas is nitrogen. Servo valve 49 has an input coupled to a nitrogen source and an output coupled to the second input of wafer carrier arm 51.

Conditioning arm 48 is used to apply an abrasive end effector onto a surface of the polishing media. The abrasive end effector planarizes the polishing media surface and cleans and roughens the surface to aid in chemical transport. Conditioning arm 48 typically is capable of both rotational and translational motion. The pressure or downforce in which the end effector presses onto the surface of the of the polishing media is controlled by conditioning arm 48.

FIG. 4 is a side view of the chemical mechanical planarization (CMP) tool 41 shown in FIG. 3. As shown in FIG. 4, conditioning arm 48 includes a pad conditioner coupling 52 and an end effector 53. CMP tool 41 further includes a polishing media 54, a carrier film 55, a carrier ring 56, a carrier assembly 57, machine mounts 58, a heat exchanger 59, an enclosure 60, and a semiconductor wafer 61.

Polishing media 54 is placed on platen 42. Typically, polishing media 54 is attached to platen 42 using a pressure sensitive adhesive. Polishing media 54 provides a suitable surface upon which to introduce a polishing chemistry. Polishing media 54 provides for chemical transport and micro-compliance for both global and local wafer surface regularities. Typically, polishing media 54 is a polyurethane pad, which is compliant and includes small perforations or annular groves throughout the exposed surface for chemical transport.

Carrier assembly 57 couples to wafer carrier arm 51. Carrier assembly 57 provides a foundation with which to rotate semiconductor wafer 61 in relation to platen 42. Carrier assembly 57 also puts a downward force on semiconductor wafer 61 to hold it against polishing media 54. A motor (not shown) allows user controlled rotation of carrier assembly 57. Carrier assembly 57 includes vacuum and gas pathways to hold semiconductor wafer 61 during planarization, profile semiconductor wafer 61, and eject semiconductor wafer 61 after planarization. Carrier ring 56 couples to carrier assembly 57. Carrier ring 56 aligns semiconductor wafer 61 concentrically to carrier assembly 57 and physically constrains semiconductor wafer 61 from moving laterally. Carrier film 55 couples to a surface of carrier assembly 57. Carrier film 55 provides a surface for semiconductor wafer 61 with suitable frictional characteristics to prevent rotation due to slippage in relation to carrier assembly 57 during planarization. In addition, the carrier film is slightly compliant as an aid to the planarization process.

Pad conditioner coupling 52 couples to conditioning arm 48. Pad conditioner coupling 52 allows angular compliance between platen 42 and end effector 53. End effector 53 abrades polishing media 54 to achieve flatness and aid in chemical transport to the surface of semiconductor wafer 61 being planarized.

Chemical reactions are sensitive to temperature. It is well known that the rate of reaction typically increases with temperature. In chemical mechanical planarization, the temperature of the planarization process is held within a certain range to control the rate of reaction. The temperature is controlled by heat exchanger 59. Heat exchanger 59 is coupled to platen 42 for both heating and cooling. For example, when first starting a wafer lot for planarization the temperature is approximately room temperature. Heat exchanger 59 heats platen 42 such that the CMP process is above a predetermined minimum temperature to ensure a minimum chemical reaction rate occurs. Typically, heat exchanger 59 uses ethylene glycol as the temperature transport/control mechanism to heat or cool platen 42. Running successive wafers through a chemical mechanical planarization process produces heat, for example, carrier assembly 57 retains heat. Elevating the temperature at which the CMP process occurs increases the rate of chemical reaction. Cooling platen 42 via heat exchanger 59 ensures that the CMP process is below a predetermined maximum temperature such that a maximum reaction is not exceeded.

Machine mounts 58 raise chemical mechanical planarization tool 41 above floor level to allow floor mounted drip pans where they are not integral to the polishing tool. Machine mounts 58 also have an adjustable feature to level CMP tool 41 and are designed to absorb or isolate vibrations.

Chemical mechanical planarization tool 41 is housed in an enclosure 60. As stated previously, the CMP process uses corrosive materials harmful to humans and the environment. Enclosure 60 prevents the escape of particulates and chemical vapors. All moving elements of CMP tool 41 are housed within enclosure 60 to prevent injury.

Operation of chemical mechanical planarization tool 41 is described hereinbelow. No specific order of steps is meant or implied in the operating description as they are determined by a large extent to the type of semiconductor wafer polishing being implemented. Heat exchanger 59 heats platen 42 to a predetermined temperature to ensure chemicals in the slurry have a minimum reaction rate when starting a chemical mechanical planarization process. A motor drives platen 42 which puts polishing media 54 in one of rotational, orbital, or linear motion.

Wafer carrier arm 51 moves to pick up semiconductor wafer 61 located at a predetermined position. The vacuum generator is enabled to provide vacuum to carrier assembly 57. Carrier assembly 57 is aligned to semiconductor wafer 61 and moved such that a surface of carrier assembly contacts the unprocessed side of semiconductor wafer 61. Carrier film 55 is attached to the surface of carrier assembly 57. Both the vacuum and carrier film 55 hold semiconductor wafer 61 to the surface of carrier assembly 57. Carrier ring 56 constrains semiconductor wafer 61 centrally on the surface of carrier assembly 57.

Multi-input valve 44 is enabled to provide slurry to pump 45. Pump 45 provides the slurry to dispense bar manifold 46. The slurry flows through dispense bar manifold 46 to dispense bar 47 where it is delivered to the surface of polishing media 54. Periodically, deionized water valve 43 is opened to provide water through dispense bar 47 to displace the slurry to prevent it from drying, settling, or agglomerating in dispense bar 47. The motion of platen 42 aids in distributing the polishing chemistry throughout the surface of polishing media 54. Typically, slurry is delivered at a constant rate throughout the polishing process.

Wafer carrier arm 51 then returns to a position over polishing media 54. Wafer carrier arm 51 places semiconductor wafer 61 in contact with polishing media 54. Polishing chemistry covers polishing media 54. Wafer carrier arm 51 puts downforce on semiconductor wafer 61 to promote friction between the slurry and semiconductor wafer 61. Polishing media 54 is designed for chemical transport which allows chemicals of the slurry to flow under semiconductor wafer 61 even though it is being pressed against the polishing media. As heat builds up in the system, heat exchanger 59 changes from heating platen 42 to cooling platen 42 to control the rate of chemical reaction.

It should be noted that it was previously stated that platen 42 is placed in motion in relation to semiconductor wafer 61 for mechanical polishing. Conversely, platen 42 could be in a fixed position and carrier assembly 57 could be placed in rotational, orbital, or translational motion. In general, both platen 42 and carrier assembly 57 are both in motion to aid in mechanical planarization.

Wafer carrier arm 51 lifts carrier assembly 57 from polishing media 54 after the chemical mechanical planarization process is completed. Wafer carrier arm 51 moves semiconductor wafer 61 to a predetermined area for cleaning. Wafer carrier arm 51 then moves semiconductor wafer 61 to a position for unloading. Vacuum generator 50 is then disabled and servo valve 49 is opened providing gas to carrier assembly 57 to eject semiconductor wafer 61.

Uniformity of the chemical mechanical planarization process is maintained by periodically conditioning polishing media 54, which is typically referred to as pad conditioning. Pad conditioning promotes the removal of slurry and particulates that build up and become embedded in polishing media 54. Pad conditioning also planarizes the surface and roughens the nap of polishing media 54 to promote chemical transport. Pad conditioning is achieved by conditioning arm 48. Conditioning arm 48 moves end effector 53 into contact with polishing media 54. End effector 53 has a surface coated with industrial diamonds or some other abrasive which conditions polishing media 54. Pad conditioner coupling 52 is between conditioning arm 48 and end effector 53 to allow angular compliance between platen 42 and end effector 53. Conditioning arm 48 is capable of rotary and translational motion to aid in pad conditioning. Pad conditioning is done during a planarization process, between wafer starts, and to condition a new pad prior to wafer processing.

As mentioned previously, peristaltic pumps as used in the process for the delivery of polishing chemistry (slurry) in chemical mechanical planarization tools do not provide the polishing chemistry at a constant rate. The rate of delivery decreases with time. The peristaltic pumps are set to a high rate of delivery to compensate for the rate decrease over time to ensure that a sufficient amount of polishing chemistry is provided to the polishing media to planarize a semiconductor wafer without damage. The high rate of delivery provides more polishing chemistry than needed, typically greater than 25 percent or more of the polishing chemistry delivered is unneeded and wasted in the planarization process.

Empirical studies show that a minimum delivery rate of polishing chemistry can be defined for each type of planarization process. Providing less than the minimum delivery rate of polishing chemistry results in non-uniformity of the wafer planarization, a decrease in polishing rate, or worse, wafer damage. Providing more than the minimum delivery rate wastes the polishing chemistry increasing manufacturing costs. A closed controlled slurry delivery system could be developed to provide the minimum delivery rate if the rate of delivery of polishing chemistry could be measured. Operating at the minimum delivery rate will reduce harmful chemicals put in the environment and reduce the cost of manufacturing integrated circuits.

Figure 5:
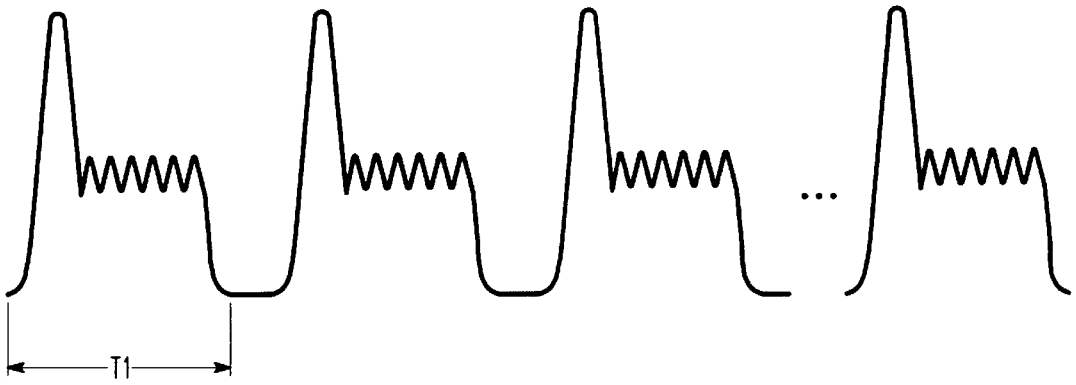
FIG. 5 is a graph illustrating slurry pressure downstream of a pump in a slurry delivery system of a CMP tool.

FIG. 5 is a graph illustrating slurry pressure downstream of a pump in a slurry delivery system of a CMP tool. A pumping cycle indicated by a time period T1 is shown in the graph. The pump cycle begins with a pressure impulse followed by smaller pressure variations with the pressure gradually falling to a lower level.

At the beginning of the pump cycle, the pump generates an extremely high pressure to start the polishing chemistry moving in the lines and components of the slurry delivery system. The pressure rapidly drops as the polishing chemistry begins to flow through the system. The pressure downstream of the pump is not stable as the polishing chemistry is pumped but fluctuates or pulses due to characteristics of the pump. For example, elastic deformation of the flexible tube in a peristaltic pump when the roller pinches the flexible tube is one factor in producing variations in pressure as material is milked from the tube. In general, a pump displaces a predetermined volume of material. In a peristaltic pump, the rotation of the pump continuously delivers a volume of material stored between rollers of the pump. The pressure falls as a given volume is depleted and the next volume is pushed into position to be delivered.

FIG. 6 is a schematic diagram of a slurry measurement system 64 for sensing a delivery rate of polishing chemistry in a CMP tool. Slurry measurement system 64 accurately measures an average flow rate of polishing chemistry being delivered to a polishing media. Real-time adjustments (regulation) to a pump are made when changes in the flow rate are detected. In particular, correction for input pressure changes and pump degradation for a peristaltic pump is possible. Regulating a pump produces substantial savings by eliminating compensation schemes that increase polishing chemistry flow rates. Moreover, a pump that accurately delivers a constant flow rate of polishing chemistry allows the pump to be set at or near the minimum required delivery rate for polishing a single semiconductor wafer.

The minimum required delivery rate assumes that there is no spent polishing chemistry or buildup of particulates on the polishing media. Operating the pump at or near the minimum required delivery rate minimizes wasted polishing chemistry thereby decreasing the cost of manufacture. Cleaning the polishing media between wafers is required to remove spent polishing chemistry and particulates.

A feedback signal from slurry measurement system 64 is provided to a pump motor control circuit 73 to maintain a constant flow rate. The feedback signal corrects for changes in flow rate. For example, a reduction in the polishing chemistry flow rate would produce a signal from slurry measurement system 64 that increases the speed of the pump. Conversely, an increase in the slurry flow rate would produce a signal from slurry measurement system 64 that decreases the speed of the pump.

In general, a pump (not shown) of a CMP tool pumps polishing chemistry to a dispense bar 65. Dispense bar 65 includes a port which outputs slurry to a polishing media on a platen 66 of the CMP tool. A pressure sensor 67 is placed downstream of the pump. Pressure sensor 67 converts the pressure to a corresponding electrical signal. The pressure of the polishing chemistry is correlated to flow rate. The correlation is easily derived empirically. For example, the flow rate is determined for a specific pressure by pumping polishing chemistry into a graduated cylinder over a predetermined time period. The volume of polishing chemistry divided by the predetermined time period is the flow rate. The flow rate measurements are taken at several pressures over the operating pressure range of the pump. Linear or second order interpolation of the data points yields a graph correlating polishing chemistry pressure to flow rate. The accuracy of the correlation relates directly to the pressure measurement.

The pressure of the pumped slurry varies during a pumping cycle (as shown in FIG. 5). A stable average pressure is measured by averaging over more than one pump cycle. In an embodiment of slurry measurement system 64, pressure sensor 67 is a mechanical device (reed switch based pressure sensor), electromagnetic mechanical structure, or micromachined semiconductor device. One type of pressure sensor utilizes a Hall effect device to generate a signal proportional to the pressure. A Hall effect device generates a voltage when a conductive element carrying current is placed in a magnetic field that is perpendicular to a plane of the element. A piston 68 in pressure sensor 67 is coupled to the polishing chemistry to sense pressure. Piston 68 is made of a magnetic material. Piston 68 is displaced proportional to the volumetric flow rate. The strength of the magnetic field generated by piston 68 on sense circuitry 69 is related to displacement. For example, a maximum displacement of piston 68 generates a maximum magnetic field on sense circuitry 69. Sense circuitry 69 generates an electrical signal corresponding to the magnetic field strength. The electrical signal is either digital or analog.

Pressure sensor 67 produces an electrical signal corresponding to the pressure shown in FIG. 5. Slurry measurement system 64 correlates the pressure and flow rate of polishing chemistry. An error source is the pressure impulse at the beginning of a pump cycle when the pump first starts to deliver a volume of material. A high slurry pressure (almost an impulse function) is generated because the pump not only has to move the volume of slurry in the pump chamber but also the slurry in the lines and components of the slurry delivery system. The pressure impulse affects the pressure sensor (producing sensor error), the exact results are dependent on the configuration and type of sensor being used.

The pressure drops to a lower level once the polishing chemistry starts moving in the slurry delivery system. The pressure impulse could also produce an error in the slurry flow measurement due to the fact that polishing chemistry is not flowing during the pressure pulse yet pressure is being measured. Filter 70 filters or reduces the magnitude of the pressure impulse to minimize its impact on the measured average pressure value.

In a first embodiment, filter 70 filters the signal above a predetermined signal level. The predetermined signal level is greater than a signal generated at a maximum pressure indicating a maximum slurry flow rate. In this embodiment, filter 70 clips the pressure impulse signal but does not affect signals corresponding to normal slurry pumping. The portion of the pressure impulse that remains does not produce significant error when an average signal is calculated.

In a second embodiment, the pressure downstream (similar to that shown in FIG. 5) of the pump is analyzed. In general, the pressure impulse signal has different frequency and magnitude characteristics than the signal produced by pressure variations observed when the pump is pumping material. For example, the pressure impulse comprises frequency components substantially higher in frequency than normal operation. In this embodiment, filter 70 is designed as a low pass filter that filters the high frequency components of the pressure impulse signal while allowing signals corresponding to normal pump operation to pass.

In a third embodiment, an average signal level produced by the pressure impulse signal is calculated or measured over a pump cycle. The average signal level produced by the pressure impulse signal is then subtracted from the averaged signal thereby eliminating the error produced by the pressure impulse. It should be noted that the three embodiments disclosed are examples which reduce error introduced by the pressure impulse at the start of a pump cycle and that slurry measurement system 64 is not limited to these embodiments alone.

A second problem is associated with the variations in pressure as the pump delivers the volume of material. The pressure variations are not consistent from pump cycle to pump cycle. A voltage average over more than one pump cycle produces a value that better reflects the true average pressure. Time averaging circuit 71 receives a filtered signal from filter 70 and generates an average value for a time period greater than one pump cycle. In an embodiment of slurry measurement system 64 time averaging circuit 71 averages over integer multiples of a pump cycle time period.

A third problem relates to human interaction with the CMP tool. A voltage reading would not produce a visual response to a CMP tool operator that automatically relates to the polishing chemistry flow rate. Voltage to frequency circuit 72 converts the voltage corresponding to the average pressure to a frequency (digital number) that is displayed on the CMP tool. The frequency is mathematically translated to a number that corresponds to the flow rate. Aberrations or changes in the polishing chemistry flow rate is easily monitored allowing operators to make visual inspections to ensure the flow rate corresponds to the appropriate polishing process and to detect when a failure occurs in the slurry delivery system. Slurry measurement system 64 is also tied into a shutdown and alarm system for the CMP tool should an unwanted condition occur.

Pump motor control circuit 73 controls the speed of the pump. A feedback signal from voltage to frequency circuit 64 is received by pump motor control circuit 73 to adjust the pump to maintain a constant flow rate. Alternately, the feedback signal could also come from time averaging circuit 71. Slurry measurement system 64 allows a flow rate to be set and maintained over the service interval of the pump with almost no error.

Figure 7:
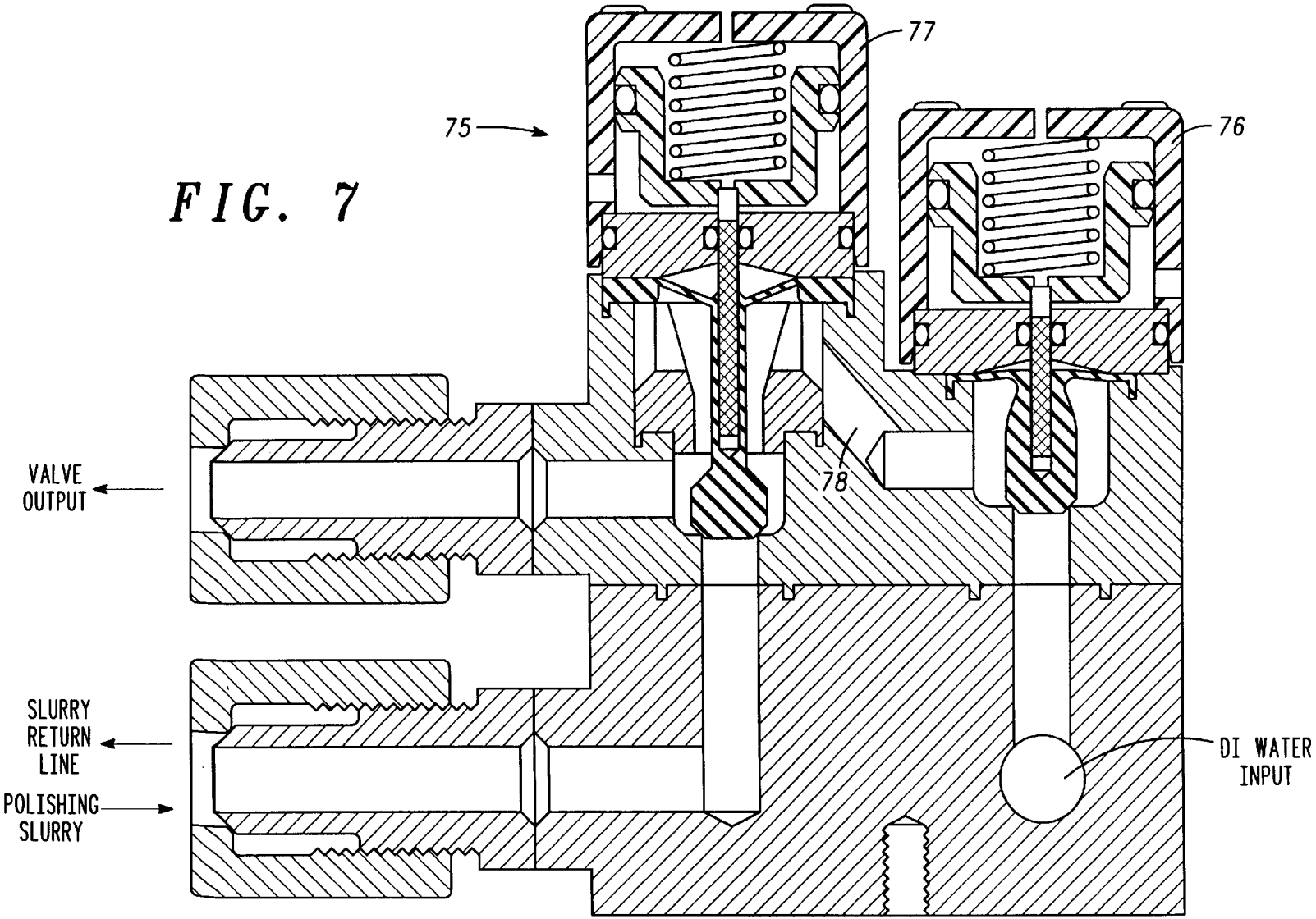
FIG. 7 is a cross-sectional view of a valve assembly for a CMP tool.

FIG. 7 is a cross-sectional view of a preferred valve assembly 75 for a CMP tool. Referring back to FIG. 2, prior art valving for switchably providing polishing chemistry and a liquid (such as DI water) to pump 31 comprises discrete valves (two way valve 28 and three way valve 29). Two way valve 28 has an input for receiving a liquid and an output. Three way valve 29 has a first input coupled to the output of two way valve 28, a second input coupled for receiving polishing chemistry and an output coupled to pump 31.

Normal operation has two way valve 28 closed to prevent DI water from being provided to pump 31. Three way valve 29 is enabled to couple the second input to the output for providing polishing chemistry to pump 31. Typically, a line connects the output of two way valve 28 to the first input of three way valve 29. In the above described mode of operation, a dead leg is formed between the output of two way valve 28 and the first input of three way valve 29. The dead leg is filled with polishing chemistry under normal conditions. The dead leg is idle for an extended time period, typically it is the time required to polish a wafer lot. The dead leg between valves 28 and 29 are subject to problems of settling, agglomeration, and hardening.

Referring back to FIG. 7, valve assembly 75 minimizes the connecting volume between the two valves by forming them in a single housing. In an embodiment of valve assembly 75, a valve actuator 76 and a valve actuator 77 are placed adjacent to one another on the housing. Valve assembly 75 includes a first input for a liquid such as DI water. Under normal operating conditions valve actuator 76 blocks a passage in the housing to prevent the flow of DI water to a pump. An electrical or pneumatic signal is used to open or close valve actuator 76. Passage 78 is the dead leg of valve assembly 75 corresponding to the connecting volume between two way valve 28 and three way valve 29 of FIG. 2. Passage 78 is made as close to valve actuator 77 as possible to minimize the volume of idle polishing chemistry. In general, the passages formed in valve assembly 75 are less than 3.2 millimeters in diameter. Valve actuator 77 is also enabled or disabled by an electrical or pneumatic signal. A second input of valve assembly 75 is coupled for receiving polishing chemistry. Valve actuator 77 is normally opened to allow the flow of polishing chemistry to the dispense bar of the slurry delivery system. An output of valve assembly 75 couples to the input of the pump of the slurry delivery system. Valve actuator 77 is closed and valve actuator 76 is opened to allow DI water to flow to the pump. The minute connecting volume of passage 78 greatly reduces problems with settling, agglomeration, and hardening.

Figure 8:
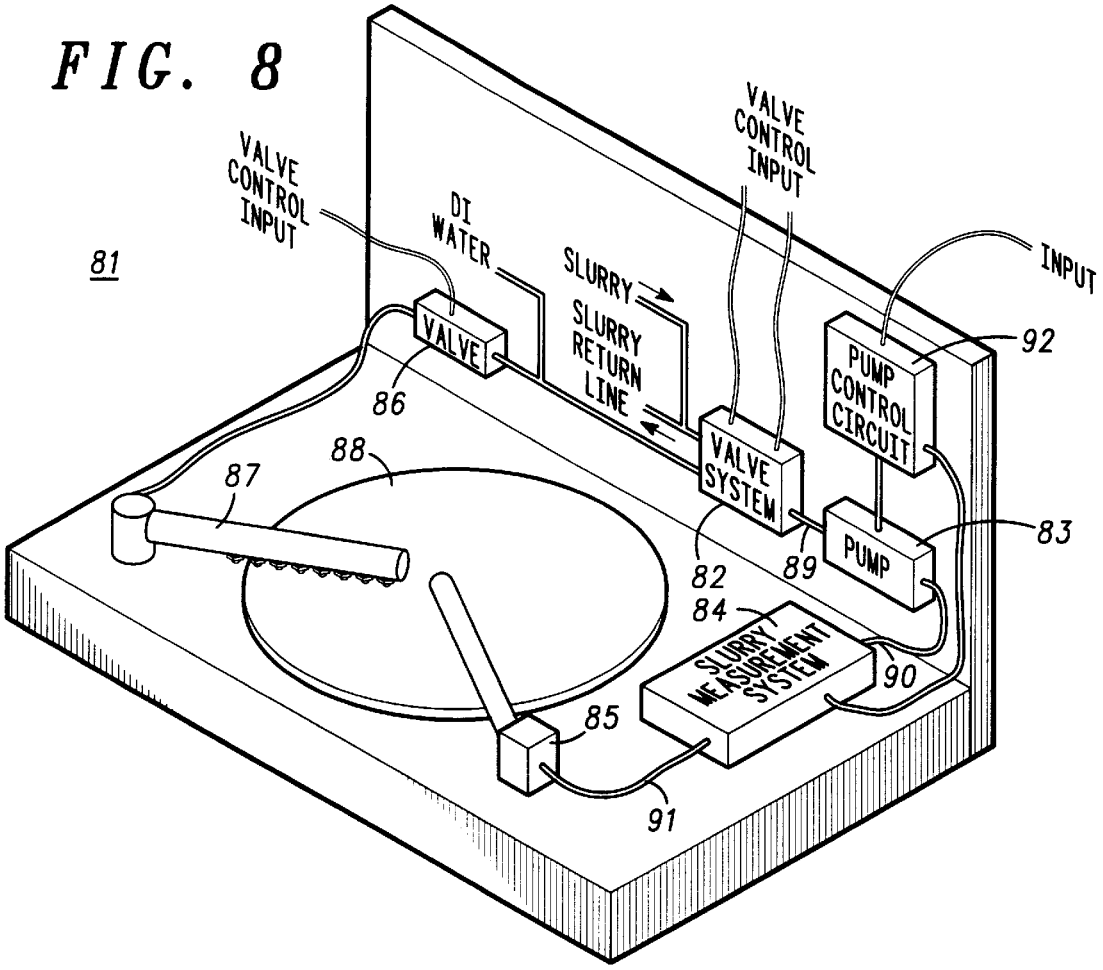
FIG. 8 is a top view of a chemical mechanical planarization tool for providing an insitu rinse step during a polishing process for each semiconductor wafer.

FIG. 8 is a top view of a chemical mechanical planarization (CMP) tool 81 for providing an insitu rinse step during a polishing process for each semiconductor wafer of a wafer lot. CMP tool 81 provides a minimum volume of polishing chemistry required to polish a single semiconductor wafer thereby optimizing the cost of manufacture. One method of determining the minimum volume of polishing chemistry is to experiment with different volumes. Applying more polishing chemistry than needed in a polishing process does not affect the quality of the wafer process but merely wastes polishing chemistry. Providing less than the minimum volume of polishing chemistry yields non-uniform results, inadequate removal of material, and wafer damage. Plotting the quality of the polishing process versus the volume should show a constant quality line from high volumes to the minimum volume with quality dropping off at lower than the minimum volume.

In an embodiment of CMP tool 81 is operated at the minimum volume or slightly above the minimum volume. Operation near the minimum volume is achieved by regulating a pump 83 such that the flow rate of pump 83 does not vary. A slurry delivery system comprises a valve system 82, pump 83, a pump control circuit 92, a slurry measurement system 84, and a dispense bar 85. The slurry delivery system is optimized to reduce a total volume between pump 83 and dispense bar 85. A technique employed to reduce the volume of the slurry delivery system is to physically move the components of the slurry delivery system close to one another. A second technique is to reduce the volume of a line 89, a line 90, and a line 91 by keeping the inner diameter of the lines equal to or less than 3.2 millimeters.

In an embodiment of CMP tool 81, valve system 82 is built similar to valve system 75 of FIG. 7. Valve system 82 has a first input, a second input, and an output. A liquid such as deionized (DI) water is coupled to the first input of valve system 82. Slurry is coupled to the second input of valve system 82. A return line returns the slurry to a global slurry delivery system if the second input is closed. Under normal operation, valve system 82 flows polishing chemistry from the second input to the output.

Pump 83 has an input, a control input, and an output. Line 89 connects the output of valve system 82 to the input of pump 83. Pump control circuit 92 has an input, a feedback input, and an output. The output of pump control circuit 92 couples to the control input of pump 83. In an embodiment of CMP tool 81, slurry measurement system 84 is similar to slurry measurement system 64 of FIG. 6. Slurry measurement system 84 has an input, a feedback output, and an output. Slurry measurement system 84 is downstream of pump 83. Line 90 connects the output of pump 83 to the input of slurry measurement system 84. The feedback output of slurry measurement system 84 couples to the feedback input of pump control circuit 92. Dispense bar 85 has an input and a port for providing polishing chemistry or liquid to a polishing media on a platen 88. Line 91 connects the output of slurry measurement system 84 to the input of dispense bar 85.

A signal applied to the input of pump control circuit 92 determines the speed of pump 83. Slurry measurement system 84 measures the average flow rate of polishing chemistry in the slurry delivery system. Any changes in the average flow rate of the polishing chemistry produces a correction signal at the feedback output of slurry measurement system 84. The correction signal adjusts the speed of pump 83 to maintain a constant flow rate.

The total volume of the slurry delivery system is kept equal to or less than 100 milliliters. An embodiment of the slurry delivery system of the present invention was placed on an IPEC 472 CMP tool which is well known in the semiconductor industry. The slurry delivery system embodiment placed on the IPEC 472 CMP tool had a total volume of approximately 25 milliliters. A DI water purge of the slurry delivery system at high speed (500 milliliters/minute) takes only 3 seconds. This is more than an order of magnitude less than the 30–60 second purge times of existing CMP tools. The low volume of material being purged and the short time period of the purge has significant benefits. First, the short time period of the purge allows it to be incorporated after each wafer is polished instead of between wafer lots. Purging the slurry delivery system during every idle period will eliminate settling, agglomeration, and hardening that can damage wafers or shut down the CMP tool. Second, the volume of DI water or other liquid being purged when polishing chemistry is brought back through the slurry delivery system does not significantly dilute the initial amount of polishing chemistry placed on the polishing media before a semiconductor wafer is polished.

Particulates or spent polishing chemistry are removed before each semiconductor wafer is polished. A rinse bar 87 rinses the polishing media of particulates and spent polishing chemistry allowing a minimum volume of polishing chemistry to be used in a wafer polishing process. A valve 86 has an input coupled for receiving a rinse liquid or DI water, a control input, and an output. Rinse bar 87 has an input coupled to the output of valve 86. The control input receives a control signal to enable valve 86 coupling the liquid to dispense bar 87. Valve 86 is typically enabled towards the end of the wafer polishing process and stays on until the polishing media surface is clean. Rinse bar 87 extends over platen 88 such that nearly all or all the radius of platen 88 is sprayed with liquid. One embodiment of a spray bar is disclosed in U.S. Pat. No. 5,578,529, by inventor James M. Mullins, issued Nov. 26, 1996, which is hereby incorporated by reference. Although shown as a separate component, rinse bar 87 can also be incorporated into dispense bar 85 or other components of a CMP tool.

A method for delivering the minimum volume during a chemical mechanical polishing process of each semiconductor wafer incorporates a rinse step and a purge step. A pump of a slurry delivery system is enabled to dispense polishing chemistry on a polishing media. The pump is regulated to ensure an accurate polishing chemistry flow rate. The slurry delivery system has a known volume. In an embodiment of the method, the pump is operated at high speed (for example, 500 milliliters a minute) for a first time period to dispense and distribute polishing chemistry. Typically, this occurs while a semiconductor wafer is being retrieved for polishing from a wafer lot. The semiconductor wafer is then placed in contact with the polishing media for planarization.

The pump is operated at a second speed while the semiconductor wafer is being polished. Polishing chemistry is dispensed to replenish the supply of slurry on the polishing media. In general, polishing chemistry is typically dispensed at a rate of 25–250 milliliters/minute depending on the process being used. The pump is disabled after a volume of polishing chemistry has been delivered approximately equal to the minimum volume minus the volume of the slurry delivery system.

The valve system is switched to prevent polishing chemistry from being coupled to the pump of the slurry delivery system. The valve system is then switched to provide a liquid such as DI water to purge the slurry delivery system. The DI water pushes out the volume of polishing chemistry in the slurry delivery system. Thus, a total volume of polishing chemistry delivered during the polishing process is equal to the minimum volume.

The slurry delivery system is purged preventing settling, agglomeration, and hardening after each wafer of the wafer lot is polished. No time is added to the polishing process by using the purge other than the time needed to switch out the polishing chemistry and switch in the purging liquid. A first factor allowing the purge is that the volume of the slurry delivery system is less than the volume being delivered during the wafer polishing process. A second factor is the time to purge the slurry delivery system is less than the time needed to remove a polished wafer and return with an unpolished semiconductor wafer. A typical time for wafer removal and return is approximately 10–15 seconds. A third factor is the volume of the slurry delivery system is small enough (less than 100 milliliters) whereby the DI water when purged from the slurry delivery system does not significantly dilute the polishing chemistry being deposited for the next semiconductor wafer to be polished.

The polishing media is sprayed with a liquid such as DI water to remove polishing chemistry and particulates from the previous semiconductor wafer polishing process. Spraying via a rinse bar is started near the end of the polishing process and during semiconductor wafer removal and return. Cleaning is further enhanced by conditioning the polishing media during the spraying step.

Operation of CMP tool 81 for polishing a semiconductor wafer is described hereinbelow. A first valve within valve assembly 82 is enabled to provide polishing chemistry to pump 82. Polishing chemistry is pumped to dispense bar 85. Dispense bar 85 may be filled with a liquid such as DI water. The liquid is displaced by the polishing chemistry. Dispense bar 85 dispenses polishing chemistry onto a polishing media on platen 88. Rotation of platen 88 aids in the distribution of polishing chemistry across a surface of the polishing media.

The pressure of the polishing chemistry is sensed downstream of pump 82 by slurry measurement system 84. The pressure is correlated to polishing chemistry flow rate. Changes in flow rate are coupled to pump control circuit 92. Pump control circuit 92 adjusts the speed of pump 83 to maintain a constant flow rate. In particular, the speed of pump 83 is set to deliver approximately a minimum amount of polishing chemistry during a semiconductor wafer polishing process.

An unpolished semiconductor wafer is placed in contact to the polishing media by a wafer carrier arm (not shown). The semiconductor wafer is polished. Dispense bar 85 replenishes polishing chemistry during the semiconductor wafer polishing process. Polishing continues as the first valve is disabled and a second valve of valve system 82 is enabled for providing a liquid such as DI water to pump 83. The DI water is pumped through the slurry delivery system. The DI displaces the polishing chemistry in the slurry delivery system (less than 100 milliliters).

Valve 86 is enabled near the end of the polishing process thereby turning on rinse bar 87 to spray the polishing media surface to remove polishing chemistry and particulates. The polished semiconductor wafer is removed from the polishing media to a wafer carrier. The process is repeated for each semiconductor wafer of a wafer lot.

Figure 9:
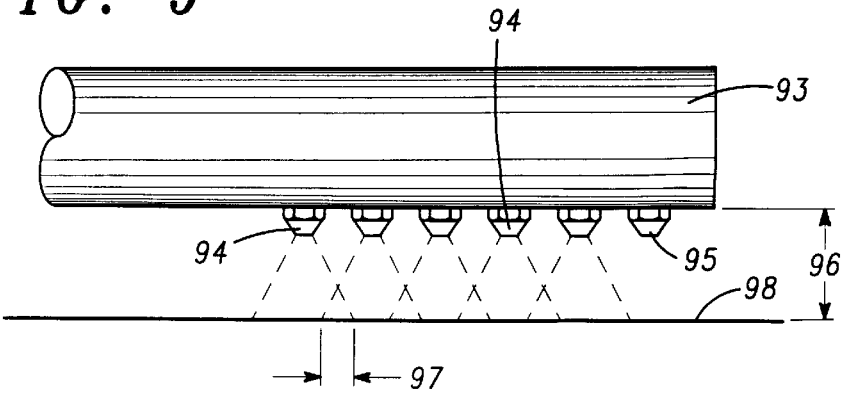
FIG. 9 is a diagram of a rinse bar for operating at common line pressures within a semiconductor factory.

FIG. 9 is a diagram of a rinse bar 93 for operating at common line pressures within a semiconductor factory. Rinse bar 93 removes polishing chemistry and particulates from a polishing media by spraying a liquid such as DI water. Most semiconductor manufacturing facilities are plumbed to provide DI water for use in the manufacture of semiconductor devices. Typical line pressures for DI water are 13.7–34.2 kilograms per square centimeter (40–100 pounds per square inch). Rinse bar 93 is capable of operating over the described input pressure range without the need of complex shields or pressure regulation to prevent spraying polishing chemistry all over the tool. This saves area and allows rinse bar 93 to be easily integrated in the tool without affecting other components of the CMP tool.

Rinse bar 93 removes polishing chemistry and particulates from the polishing media without spraying it all over the CMP tool. Polishing chemistry sprayed on CMP tool components can affect operation or fall back onto the polishing media damaging semiconductor wafers. Rinse bar 93 comprises more than one spray nozzle 94, each spray nozzle putting out a spray fan of liquid. The volume and velocity of the liquid must impart enough force to physically lift the polishing chemistry and particulates from the polishing media to provide adequate removal.

A usable range of orifice size for nozzles 94 is 0.27 to 1.00 millimeters. In an embodiment of rinse bar 93, spray nozzles 94 have an orifice size of approximately 0.43 millimeters. Nozzles 94 are serially aligned across rinse bar 93. The spray fans of nozzles 94 form a spray path that covers a radius of a platen. Nozzles 94 spray substantially vertical to a surface 98 of the polishing media. Vertical spraying displaces polishing chemistry and particulates without spraying on other components of the CMP tool.

A height 96 of rinse bar 93 above surface 98 of the polishing media is in a range of 1.9–6.4 centimeters. In an embodiment of rinse bar 93, height 96 is approximately 3.5 centimeters above surface 98 of the polishing media. Visible rebound of the polishing chemistry is less than 1.3 centimeters.

As mentioned previously, each nozzle puts out a spray fan of the liquid that hits surface 98 of the polishing media. The velocity of the liquid at the outside of the spray fan is substantially less than the velocity of the liquid in the interior of the spray fan. Nozzles 94 are spaced such that spray fans of adjacent nozzles overlap one another by more than 25 percent of the spray fan width. The increased spray volume from adjacent spray nozzles in an overlap area 97 compensates for the reduced velocity. In an embodiment of rinse bar 93 each spray nozzle produces a 110 degree spray fan and overlap area 97 is approximately 33 percent of the total spray fan width.

A nozzle 95 is angled to drive polishing chemistry off of the polishing media. In an embodiment of rinse bar 93, nozzle 95 is placed at the end of rinse bar 93. Nozzle 95 is angled such that the spray fan forms an angle between 30–60 degrees with surface 98 of the polishing media. The angle produces a force parallel to the surface 98 that pushes the polishing chemistry off the polishing media.

By now it should be appreciated that an apparatus and method for polishing a semiconductor wafer has been provided. The CMP tool includes a rinse bar for removing polishing chemistry from the polishing media and a slurry measurement system for sensing a flow rate of polishing chemistry in a slurry delivery system. The slurry measurement system provides a feedback signal to a pump control circuit that adjusts or regulates a pump speed to provide a constant flow rate. The volume of the slurry delivery system is reduced to less than 100 milliliters.

The rinse bar, reduced volume of the slurry delivery system, and pump regulation allows a significant reduction in the volume of polishing chemistry being used for each semiconductor wafer. Approximately a minimum volume of polishing chemistry for polishing a single wafer is dispensed during each wafer polishing process. The volume of the slurry delivery system is less than the minimum volume. Polishing chemistry is coupled to a pump of the slurry delivery system. The pump is enabled for a period of time to provide an amount approximately equal to the minimum volume less the volume of the slurry delivery system. The pump is disabled and the polishing chemistry decoupled from the pump. A liquid such as DI water is coupled to the pump and the pump is enabled. The slurry delivery is purged of polishing chemistry which is dispensed to the polishing media. The DI water purge prevents settling, agglomeration, or hardening from occurring before the next semiconductor wafer is polished. The polishing media is sprayed with a liquid such as DI water to remove polishing chemistry and particulates that could affect the polishing of the next wafer.

What is claimed is:

1. A chemical mechanical planarization tool for providing an in situ rinse step during a semiconductor wafer planarization process to increase wafer uniformity over a wafer lot comprising:

a platen for supporting a semiconductor wafer;

a pump for pumping a rinse material, the pump having an input and an output;

a dispense bar having an input for receiving the material and having a port;

a first line for connecting the pump to the dispense bar by coupling said output of said pump to said input of said dispense bar wherein said pump, said first line, and said dispense bar have a combined volume less than 100 milliliters; and a rinse bar having an input for receiving a liquid and at lease one spray nozzle.

2. The chemical mechanical planarization tool as recited in claim 1 wherein said first line has an inner diameter less than or equal to 3.2 millimeters.

3. The chemical mechanical planarization tool as recited in claim 2 further including:

a first valve having an input for receiving a liquid and an output; and a second valve having a first input coupled to said output of said first valve, a second input coupled for receiving a polishing chemistry, and an output.

4. The chemical mechanical planarization tool as recited in claim 3 wherein said first and second valves are formed in a single housing to minimize a connecting volume between said first and second valves.

5. The chemical mechanical planarization tool as recited in claim 3 further including a second line coupling said output of said first valve to said first input of said second valve, said second line having an inner diameter less than 3.2 millimeters.

6. The chemical mechanical planarization tool as recited in claim 1 further including:

a slurry flow meter responsive to said polishing chemistry downstream of said pump; and a pump control circuit for controlling a speed of said pump, said pump control circuit being responsive to said slurry flow meter and an input signal.

7. The chemical mechanical planarization tool as recited in claim 6 wherein said slurry flow meter comprises:

a pressure sensing device responsive to a polishing chemistry pressure downstream of said pump;

a filter responsive to said pressure sensing device; and a time averaging circuit responsive to said filter for providing a signal corresponding to an average pressure of said polishing chemistry downstream of said pump for more than one pump cycle.

8. The chemical mechanical planarization tool as recited in claim 7 further including a voltage to frequency circuit responsive to said time averaging circuit.

9. The chemical mechanical planarization tool as recited in claim 7 wherein said pressure sensing device is a Hall effect pressure sensing device.

10. The chemical mechanical planarization tool as recited in claim 7 wherein said pressure sensing device is a micromachined semiconductor device.

11. The chemical mechanical planarization tool as recited in claim 7 wherein said filter filters a signal from said pressure sensing device above a predetermined level.

12. The chemical mechanical planarization tool as recited in claim 7 wherein said filter is a low pass filter.

13. The chemical mechanical planarization tool as recited in claim 7 wherein a signal corresponding to a pressure impulse is subtracted from said signal corresponding to an average pressure.

14. The chemical mechanical planarization tool as recited in claim 3 further including a third valve having an input for receiving a liquid and an output coupled to said input of said rinse bar.

15. The chemical mechanical planarization tool as recited in claim 1 wherein said rinse bar includes a plurality of nozzles for spraying substantially vertical to a surface of said platen.

16. The chemical mechanical planarization tool as recited in claim 15 wherein said plurality of nozzles are spaced such that spray fans of adjacent spray nozzles of said plurality of nozzles overlap each other by 25 percent or more at a surface of a polishing media.

17. The chemical mechanical planarization tool as recited in claim 16 wherein said plurality of nozzles have an orifice size between 0.27 and 1.00 millimeters.

18. The chemical mechanical planarization tool as recited in claim 17 wherein said rinse bar includes at least one angled spray nozzle, said at least one angled spray nozzle for spraying liquid to drive polishing chemistry and particulates off of said polishing media.

19. The chemical mechanical planarization tool as recited claim 18 wherein said rinse bar is mounted between 1.8 and 5.0 centimeters from said surface of said polishing media.

20. A chemical mechanical planarization tool as recited in claim 1 further including:

a wafer carrier arm;

a carrier assembly coupled to said wafer carrier arm, said carrier assembly for holding said semiconductor wafer, said wafer carrier arm for moving said semiconductor wafer in contact with a surface of a polishing media;

a conditioning arm;

pad conditioner coupling coupled to said conditioning arm; and an end effector coupled to said pad conditioner coupling, said pad conditioner coupling for providing angular compliance between said platen and said end effector, said end effector for conditioning said polishing media.

* * * * *